US010384927B2

(12) United States Patent
Mathers et al.

(10) Patent No.: US 10,384,927 B2
(45) Date of Patent: Aug. 20, 2019

(54) SYSTEMS AND METHODS FOR MOBILE FUEL TRANSLOADING

(71) Applicant: Pro Petroleum, Inc., Phoenix, AZ (US)

(72) Inventors: Michael Mathers, Phoenix, AZ (US); Justin Miller, Las Vegas, NV (US); Matthew Wichman, Las Vegas, NV (US); Mark Moody, Avondale, AZ (US)

(73) Assignee: Pro Petroleum, Inc., Phoenix, AZ (US)

( * ) Notice: Subject to any disclaimer, the term of this patent is extended or adjusted under 35 U.S.C. 154(b) by 301 days.

(21) Appl. No.: 15/481,458

(22) Filed: Apr. 7, 2017

(65) Prior Publication Data

US 2018/0290878 A1 Oct. 11, 2018

(51) Int. Cl.

| | |
|---|---|
| ***B67D 7/00*** | (2010.01) |
| ***B67D 7/22*** | (2010.01) |
| ***B67D 7/84*** | (2010.01) |
| ***B67D 7/04*** | (2010.01) |
| ***B67D 7/16*** | (2010.01) |
| ***B67D 7/66*** | (2010.01) |

(Continued)

(52) U.S. Cl.

CPC ..... *B67D 7/845* (2013.01); *B67D 7/002* (2013.01); *B67D 7/04* (2013.01); *B67D 7/16* (2013.01); *B67D 7/22* (2013.01); *B67D 7/66* (2013.01); *B67D 7/362* (2013.01); *B67D 7/76* (2013.01); *B67D 7/763* (2013.01)

(58) Field of Classification Search

CPC . B67D 7/845; B67D 7/66; B67D 7/16; B67D 7/04; B67D 7/002; B67D 7/22; B67D 7/76; B67D 7/763; B67D 7/362

See application file for complete search history.

(56) References Cited

U.S. PATENT DOCUMENTS 4,718,443 A 1/1988 Adney et al.
4,819,183 A 4/1989 O'Brien et al.

(Continued)

FOREIGN PATENT DOCUMENTS

WO 2015022517 2/2015

OTHER PUBLICATIONS

Wilson, Charles E., Biofuel Bonanza: KAG launches massive ethanol logistics effort, Bulk Transporter, 70(10): pp. 18-22, Apr. 1, 2008.

(Continued)

*Primary Examiner* — Jason K Niesz
(74) *Attorney, Agent, or Firm* — Michelle L. Gross, P.C.

(57) ABSTRACT

A mobile liquid transferring system comprising a first articulating fluid conduit configured to couple to a first tank, a pump comprising a pump inlet in fluid communication with the first articulating fluid conduit, a flow meter comprising a first pickoff for a first liquid of a first viscosity and a second pickoff for a second liquid of a second viscosity, a meter register configured to control flow of the first liquid and the second liquid in accordance with one or more loading parameters and one or more liquid parameters, a flow control valve in fluid communication with the flow meter and configured to alter flow of at least one of the first liquid and the second liquid in response to a communication from the load rack controller, and a second articulating fluid conduit in fluid communication with the flow control valve and configured to couple to a second tank.

20 Claims, 17 Drawing Sheets

(51) Int. Cl.
*B67D 7/76* (2010.01)
*B67D 7/36* (2010.01)

(56) References Cited

U.S. PATENT DOCUMENTS

| | | | | |
|---|---|---|---|---|
| 5,630,528 | A | 5/1997 | Nanaji | |
| 8,109,300 | B2 * | 2/2012 | Brakefield | B67D 7/04 141/231 |
| 8,393,360 | B2 | 3/2013 | Brakefield et al. | |
| 8,967,174 | B1 | 3/2015 | Perreault | |
| 9,133,014 | B2 | 9/2015 | Kenan et al. | |
| 9,162,865 | B2 | 10/2015 | Falcone | |
| 2005/0184084 | A1 | 8/2005 | Wells | |
| 2013/0035788 | A1 | 2/2013 | Divelbliss et al. | |
| 2013/0332060 | A1 | 4/2013 | Chowdhary | |
| 2014/0053948 | A1 | 2/2014 | Falcone | |
| 2014/0352830 | A1 | 12/2014 | Kenan et al. | |

OTHER PUBLICATIONS

Toptech Systems, UAP Unified Automation Platform product brochure, accessed May 3, 2016.

* cited by examiner

SYSTEMS AND METHODS FOR MOBILE FUEL TRANSLOADING

BACKGROUND

1. Field of the Invention

Example embodiments in general relate to systems and methods for mobile fuel transloading.

2. Related Art

Transloading within the context of the petroleum industry typically describes the transfer of crude oil, refined products such as gasoline, diesel fuel, of renewable fuel products such as ethanol or biodiesel from one transportation vessel to another. The most common transloading operations involve the transfer of materials from railroad tank car to a tank truck or from a tank truck to a railroad tank car.

Stationary transloading terminals, while typically not limited in the type or quantity of equipment the terminal may encompass suffer from the disadvantage that the transloading must be accomplished at the location of the transloading terminal. Mobile transloading equipment is typically of a crude nature and conventionally comprises basic equipment mounted on a flatbed or enclosed trailer which is often difficult to operate and may be prone to frequent vapor-lock.

SUMMARY

Implementations of a mobile liquid transferring system may comprise a first articulating fluid conduit configured to couple to a first tank, a pump positioned on a platform, the pump comprising a pump inlet and a pump outlet, the pump inlet in fluid communication with the first articulating fluid conduit, and a flow meter in fluid communication with the pump, the flow meter comprising a first pickoff for a first liquid of a first viscosity and a second pickoff for a second liquid of a second viscosity. Some implementations may comprise a meter register configured to control flow of the first liquid and the second liquid in accordance with one or more loading parameters and one or more liquid parameters, a flow control valve in fluid communication with the flow meter and configured to alter flow of at least one of the first liquid and the second liquid in response to a communication from the meter register, and a second articulating fluid conduit in fluid communication with the flow control valve and configured to couple to a second tank.

Particular aspects may comprise one or more of the following features. At least one of the first articulating fluid conduit and the second articulating fluid conduit may comprise a spring proximal a joint, the spring configured to counterbalance a weight of at least a portion of the at least one of the first articulating fluid conduit and the second articulating fluid conduit. At least one of the first articulating fluid conduit and the second articulating fluid conduit may be configured to retract and be positioned proximal the platform when uncoupled from at least one of the first tank and the second tank. At least one of the first articulating fluid conduit and the second articulating fluid conduit may further comprise a dry brake coupler. The mobile liquid transferring system may further comprise an air eliminator configured to remove air from at least one of the first liquid and the second liquid when either the first liquid or the second liquid is flowing through the mobile liquid transferring system. The mobile liquid transferring system may further comprise a remote terminal unit configured to communicate with a remotely located terminal management system. The mobile liquid transferring system may further comprise a vapor balance system configured to balance vapor emitted by at least one of the first liquid and the second liquid. The mobile liquid transferring system may further comprise an in-line strainer. The mobile liquid transferring system may further comprise an overfill prevention control unit. The mobile liquid transferring system may further comprise a fire suppression system.

Implementations of a mobile liquid transferring system may comprise a first articulating fluid conduit configured to couple to a first tank, a pump positioned on a platform, the pump comprising a pump inlet and a pump outlet, the pump inlet in fluid communication with the first articulating fluid conduit, and a flow meter in fluid communication with the pump. Some implementations may further comprise a meter register configured to control flow of a liquid in accordance with one or more loading parameters and one or more liquid parameters, a flow control valve in fluid communication with the flow meter and configured to alter flow of the liquid in response to a communication from the meter register, and a second articulating fluid conduit in fluid communication with the flow control valve and configured to couple to a second tank, wherein at least one of the first articulating fluid conduit and the second articulating fluid conduit comprise a spring proximal a joint and a dry brake coupler configured to couple the at least one of the first articulating fluid conduit and the second articulating fluid conduit to at least one of the first tank and the second tank.

Particular aspects may comprise one or more of the following features. The flow meter may comprise a first pickoff for a first liquid of a first viscosity and a second pickoff for a second liquid of a second viscosity and the meter register is configured to control flow of the first liquid and the second liquid in accordance with the one or more loading parameters and the one or more liquid parameters. At least one of the first articulating fluid conduit and the second articulating fluid conduit may be are configured to retract and be positioned proximal the platform when uncoupled from at least one of the first tank and the second tank. The mobile liquid transferring system may further comprise an air eliminator configured to remove air from the liquid when the liquid is flowing through the mobile liquid transferring system. The mobile liquid transferring system may further comprise an overfill prevention control unit configured to stop flow of the liquid upon detection that the second tank is overfilled and verify that the mobile liquid transferring system is at an electrical ground.

Implementations of a mobile liquid transferring system may comprise a first fluid conduit configured to couple to a first tank, a pump positioned on a platform, the pump comprising a pump inlet and a pump outlet, the pump inlet in fluid communication with the first fluid conduit, and a flow meter in fluid communication with the pump, the flow meter comprising a first pickoff for a first liquid of a first viscosity and a second pickoff for a second liquid of a second viscosity. Some implementations may further comprise a meter register configured to control flow of the first liquid and the second liquid in accordance with one or more loading parameters and one or more liquid parameters, a flow control valve in fluid communication with the flow meter and configured to alter flow of at least one of the first liquid and the second liquid in response to a communication from the meter register, and a second fluid conduit in fluid communication with the flow control valve and configured to couple to a second tank.

Particular aspects may comprise one or more of the following features. The mobile liquid transferring system may further comprise a remote terminal unit configured to communicate with a remotely located terminal management system. The mobile liquid transferring system may further comprise a vapor balance system configured to balance vapor emitted by at least one of the first liquid and the second liquid. At least one of the first fluid conduit and the second fluid conduit may be configured to retract and be positioned proximal the platform when uncoupled from at least one of the first tank and the second tank. The mobile liquid transferring system may further comprise an overfill prevention control unit configured to stop flow of the liquid upon detection that the second tank is overfilled and verify that the mobile liquid transferring system is at an electrical ground.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Brief Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein. Elements and acts in the figures are illustrated for simplicity and have not necessarily been rendered according to any particular sequence or embodiment.

DETAILED DESCRIPTION

Figure 1:
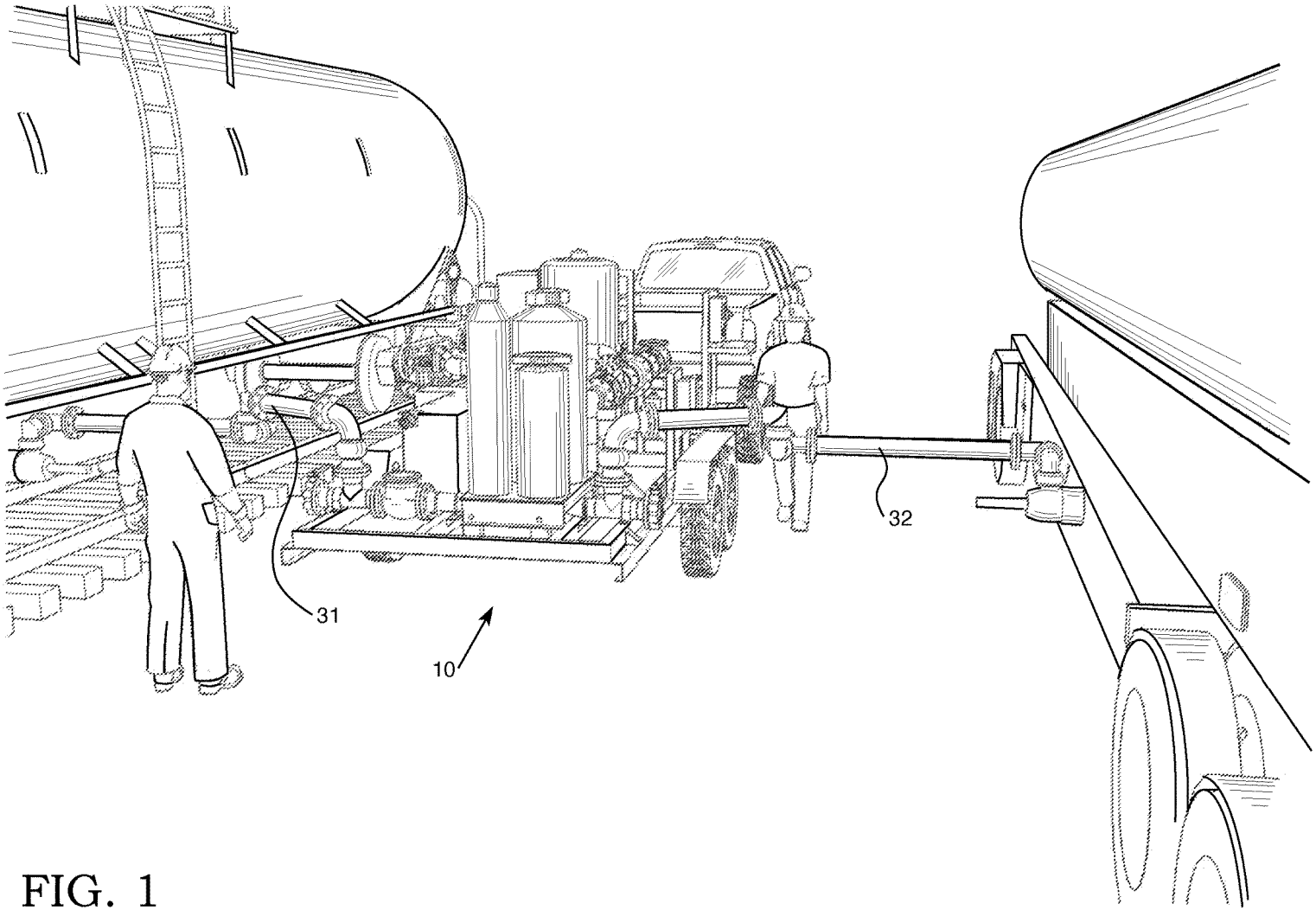
FIGS. 1-2 depict an exemplary embodiment of a mobile fuel transloading system in use moving fuel from a rail car to a tanker truck.

Unless otherwise defined, all technical and scientific terms used herein have the same meaning as commonly understood by one of ordinary skill in the art to which this invention belongs. Although methods and materials similar to or equivalent to those described herein can be used in the practice or testing of a mobile fuel transloading system, suitable methods and materials are described herein. All publications, patent applications, patents, and other references mentioned herein are incorporated by reference in their entirety to the extent allowed by applicable law and regulations. The mobile fuel transloading system may be embodied in other specific forms without departing from the spirit or essential attributes thereof, and it is therefore desired that the present embodiments be considered in all respects as illustrative and not restrictive. Any headings utilized within the description are for convenience only and have no legal or limiting effect.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. As used herein, phrases such as "make contact with," "coupled to," "touch," "interface with" and "engage" may be used interchangeably.

The features, structures, or characteristics of the invention described throughout this specification may be combined in any suitable manner in one or more embodiments. For example, the usage of the phrases "exemplary embodiments", "some embodiments" or other similar language refers to the fact that a particular feature, structure, or characteristic described in connection with the embodiment may be included in at least one embodiment of the present invention. Thus, appearances of the phrases "exemplary embodiments", "in some embodiments", "in other embodiments" or other similar language, throughout this specification do not necessarily all refer to the same group of embodiments, and the described features, structures, or characteristics may be combined in any suitable manner in one or more embodiments.

Implementations of the mobile fuel transloading system 10 as disclosed herein may be designed to address one or more of the following disadvantages of existing mobile fuel transloading systems: 1) automation, communications, and data capture functionality is limited or nonexistent, resulting in lost or erroneous transactional data/documents; 2) electrical, control and communication systems may not be designed and rated for use with products where combustible vapors may be present; 3) measurement and automation equipment/systems may be limited to measuring products of a very limited American Petroleum Institute (API) gravity or specific gravity range without replacement or recalibration of equipment; 4) spill mitigation and vapor control equipment may be limited or nonexistent; 5) operation of the equipment may be labor-intensive and physically demanding, require lifting and draining of heavy, product-filled transfer hoses and similar activities; 6) transfer and/or pumping systems may be prone to frequent vapor-lock under certain conditions, resulting from a lack of air-elimination functionality.

Figure 2:
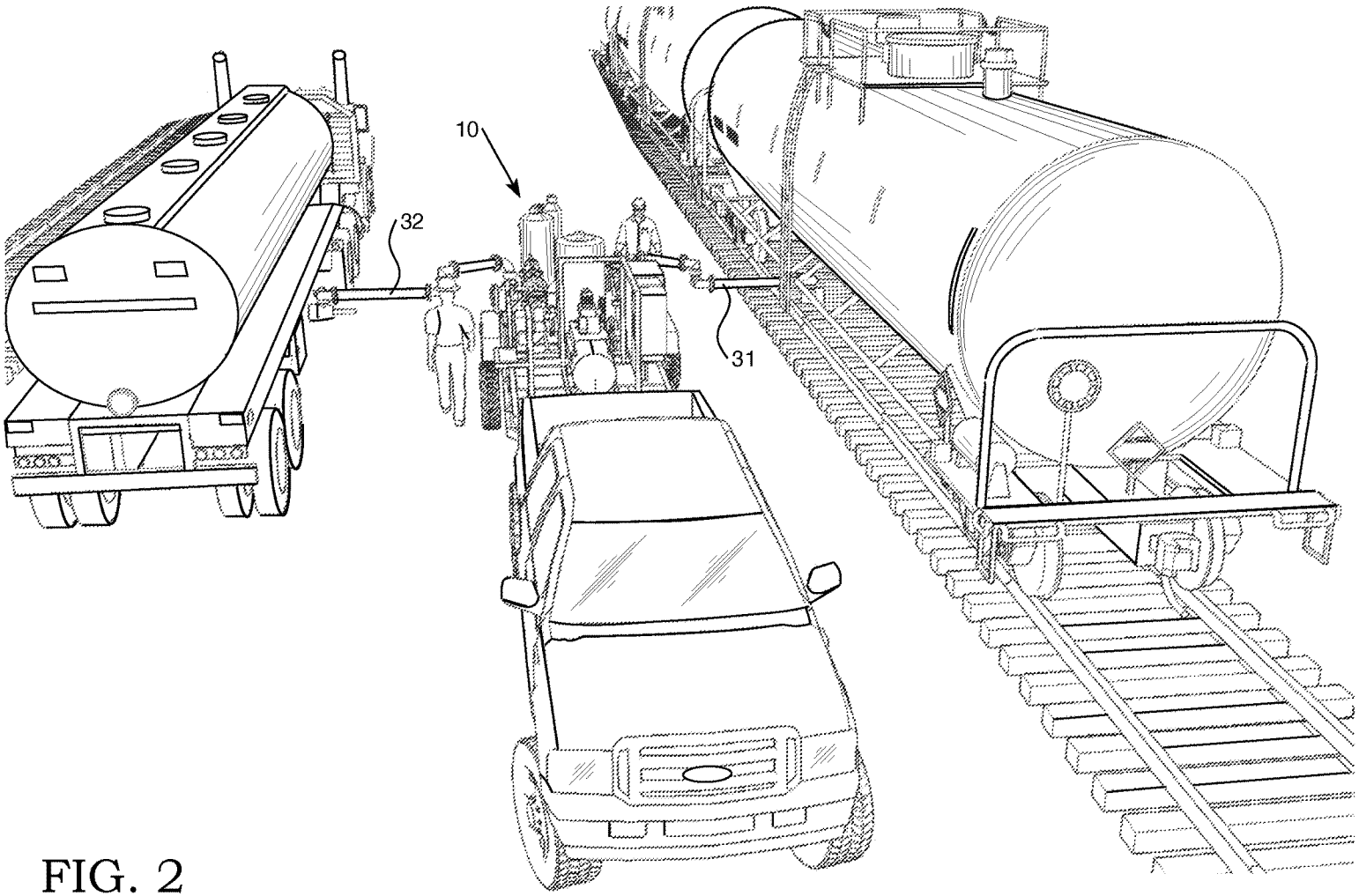
Figure 3:
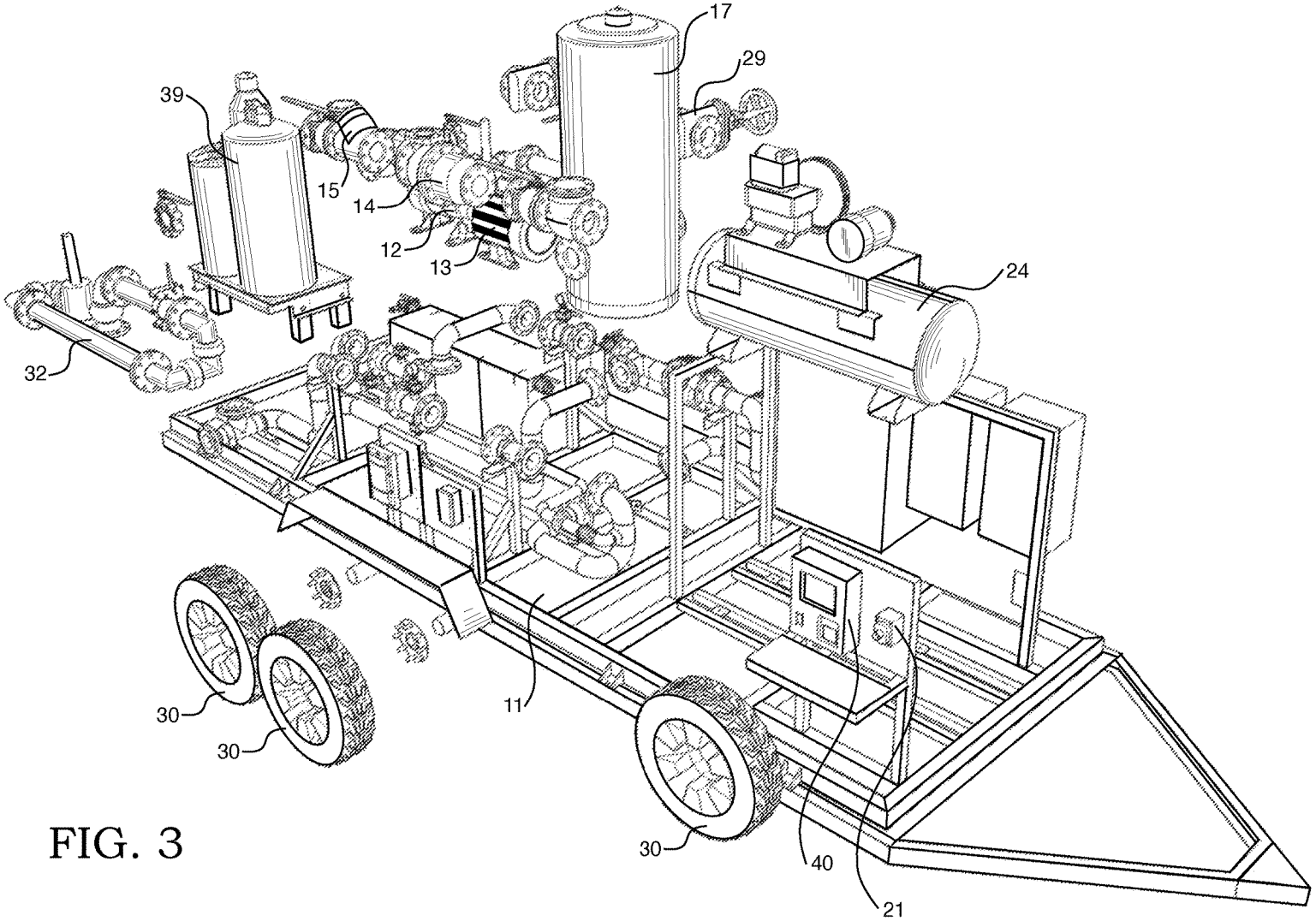
FIGS. 3-10 provide exploded views of an implementation of a mobile fuel transloading system from various angles of perspective.
Figure 4:
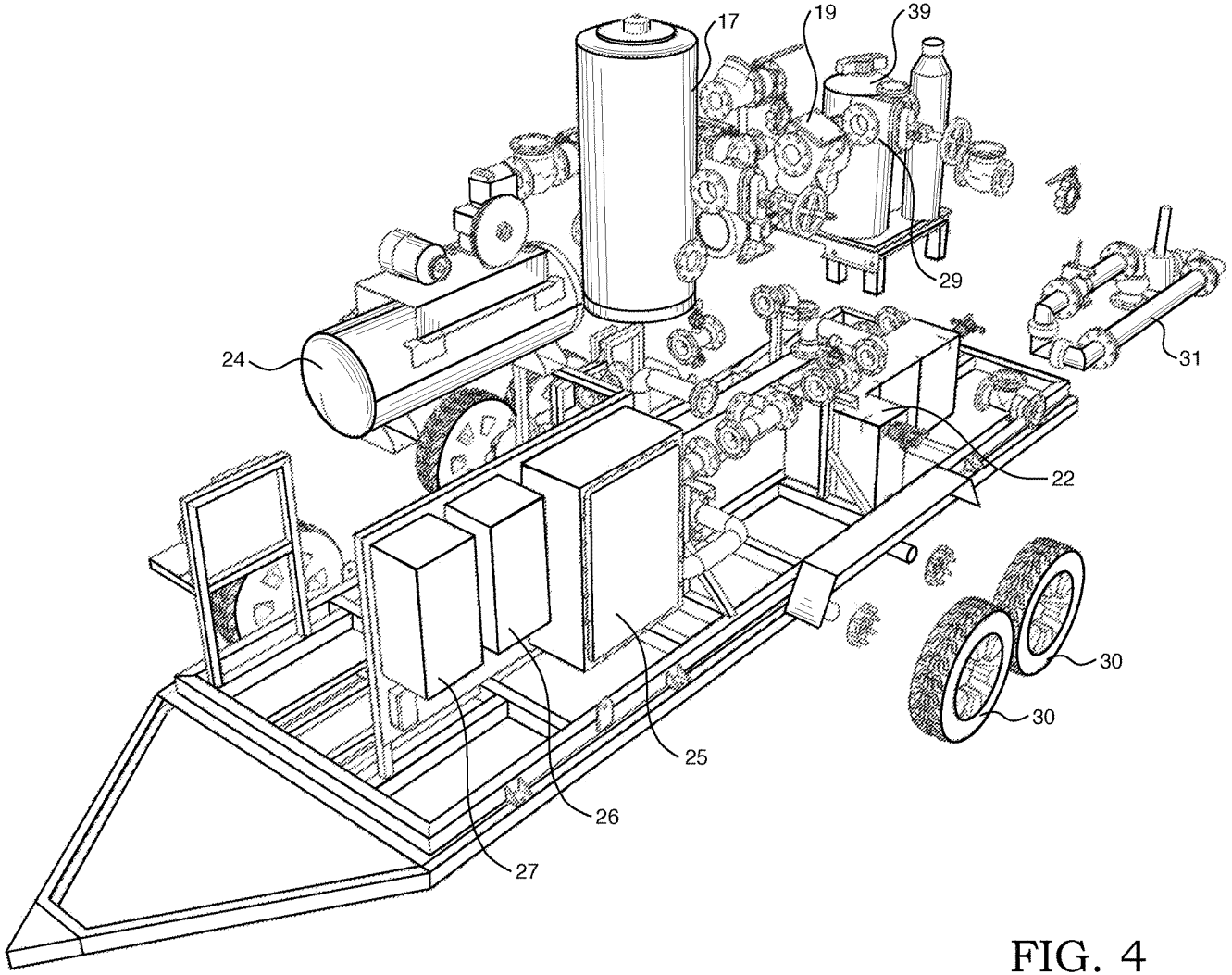
Figure 5:
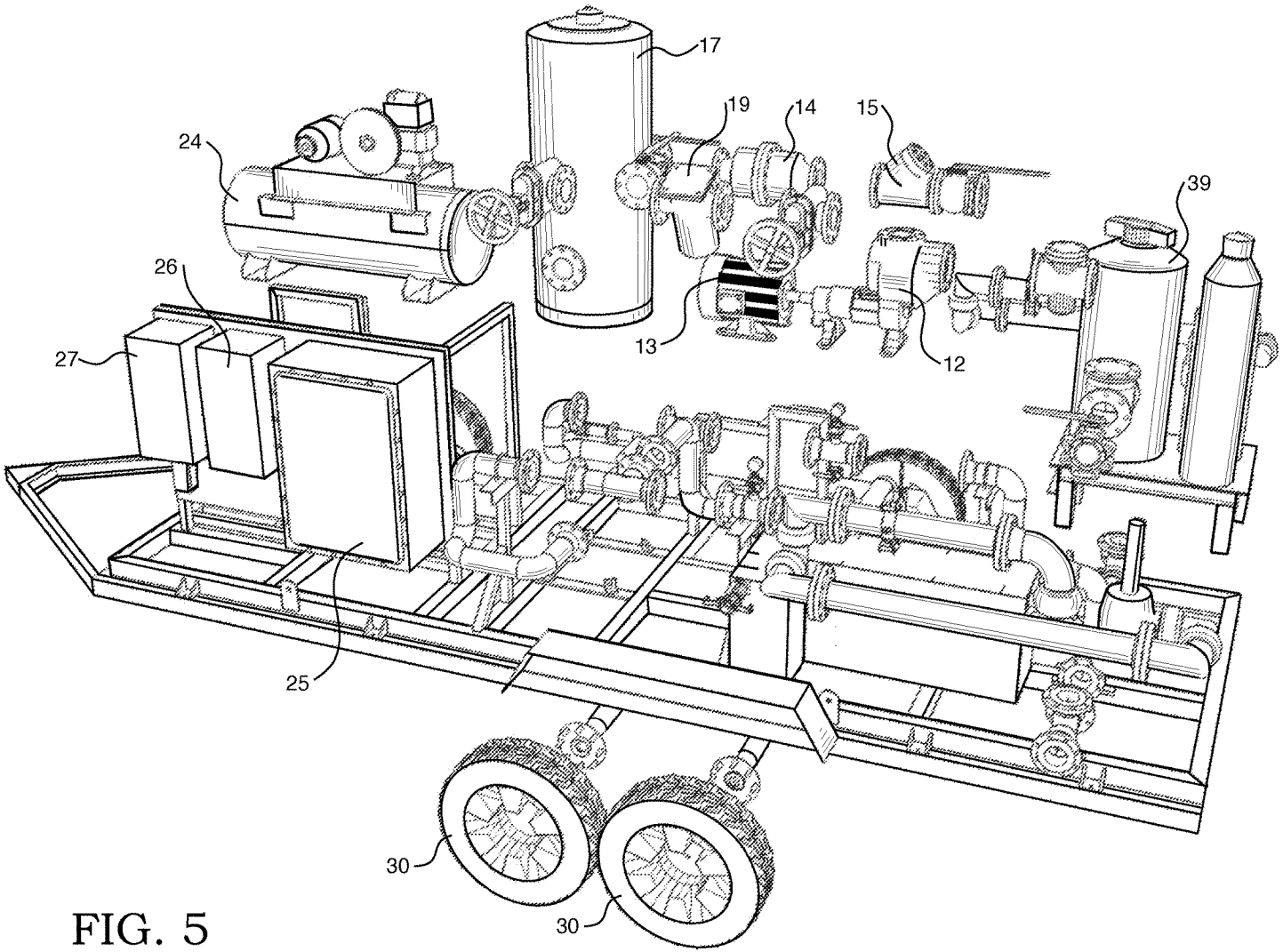
Figure 6:
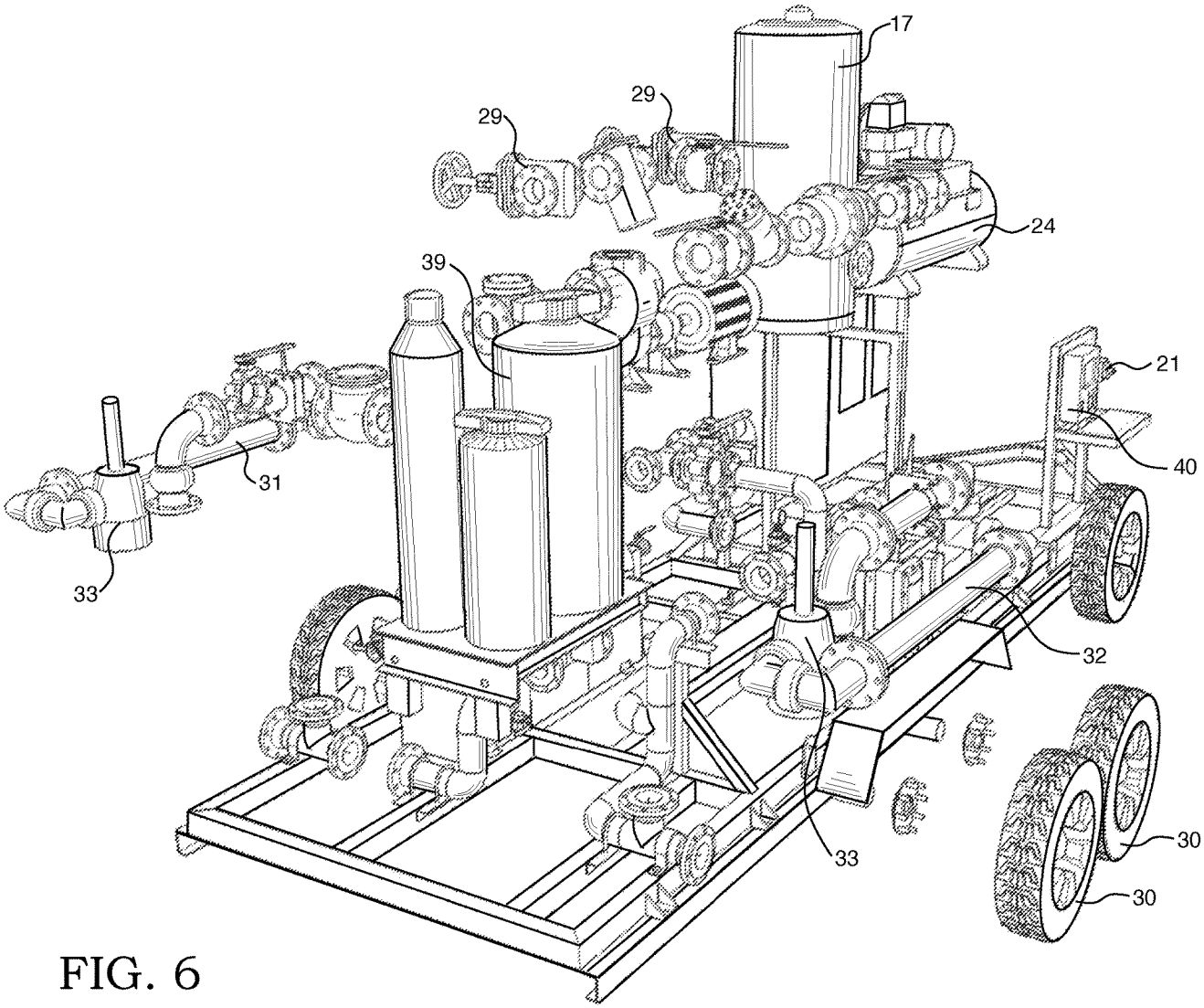
Figure 7:
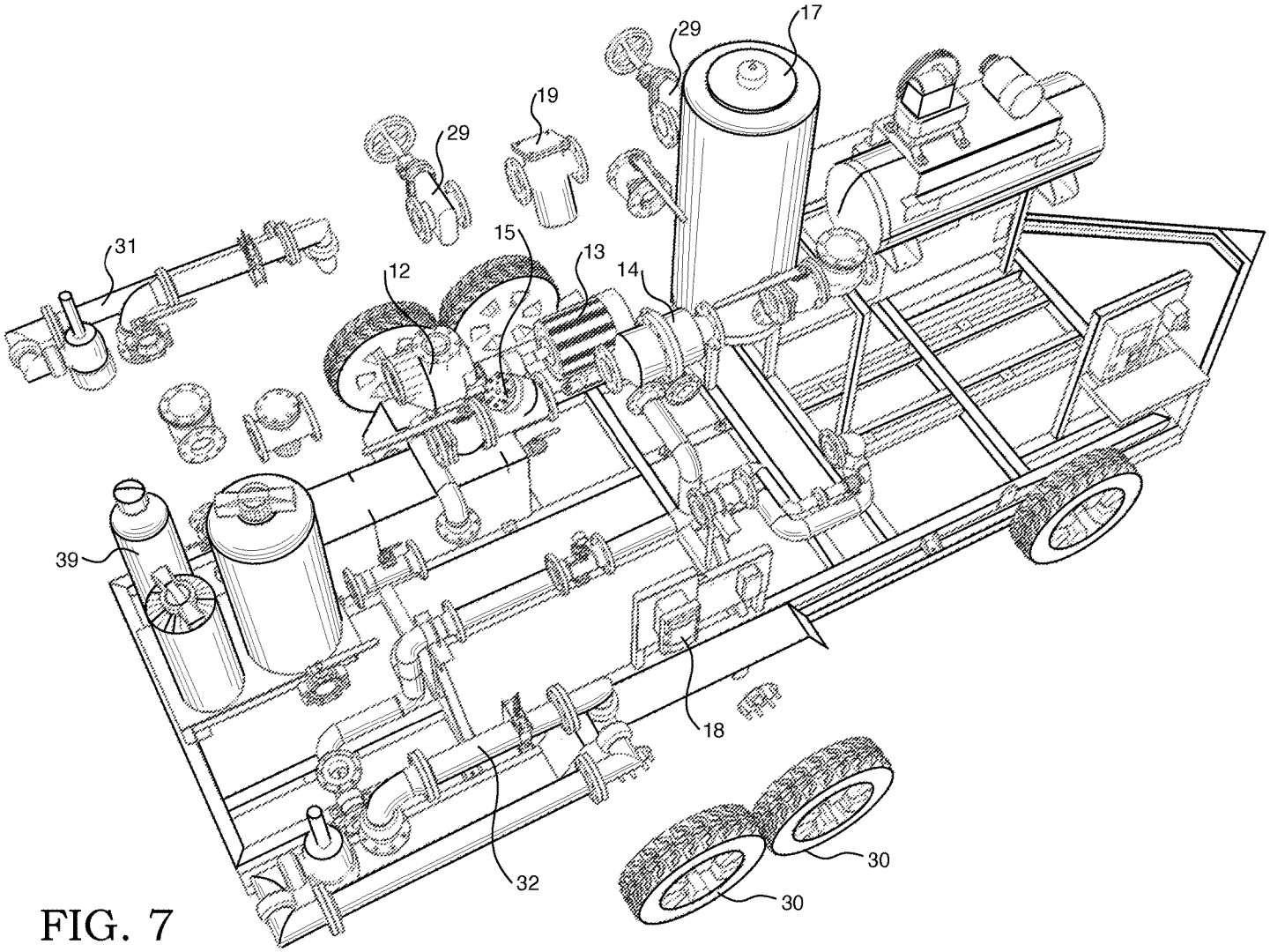
Figure 8:
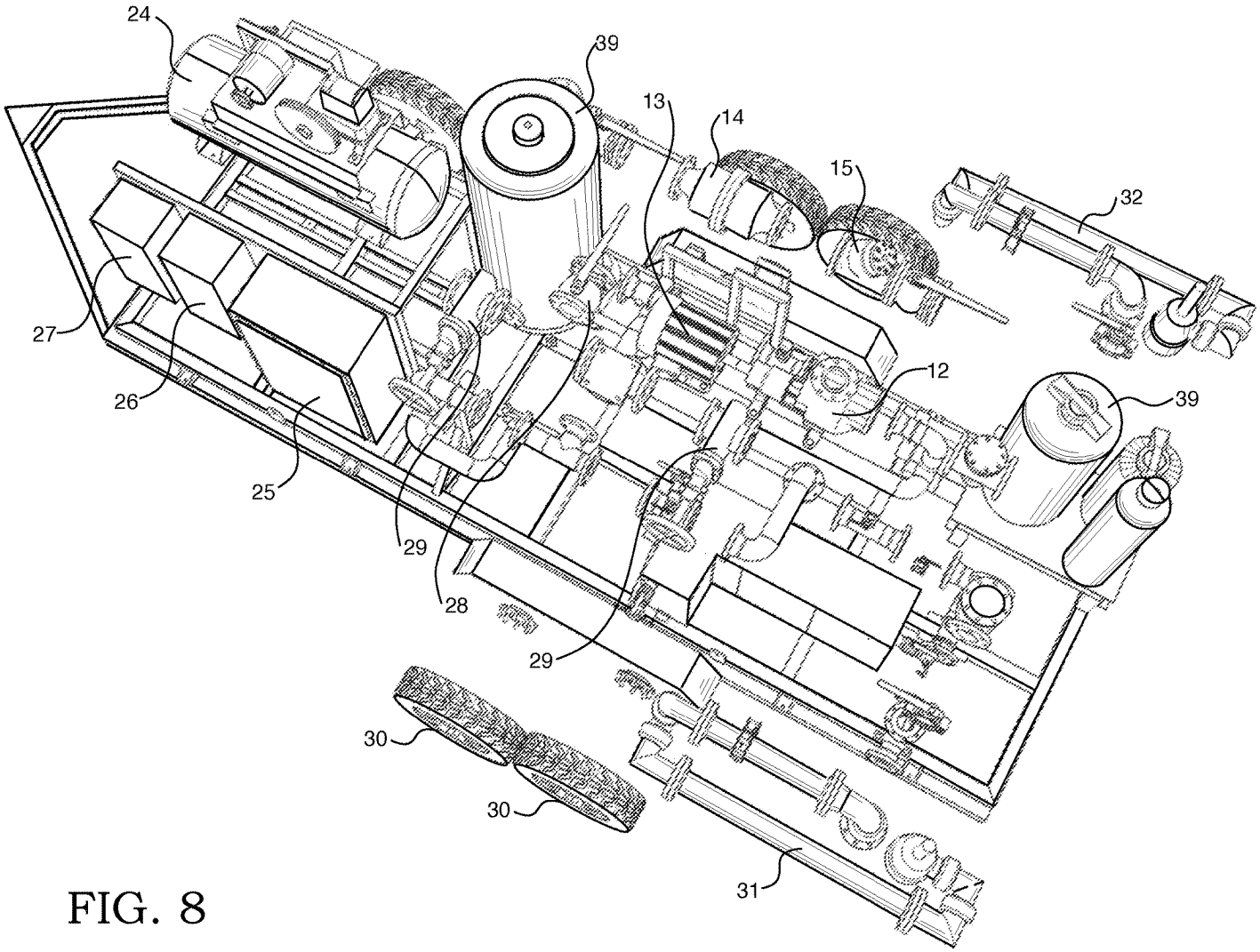
Figure 9:
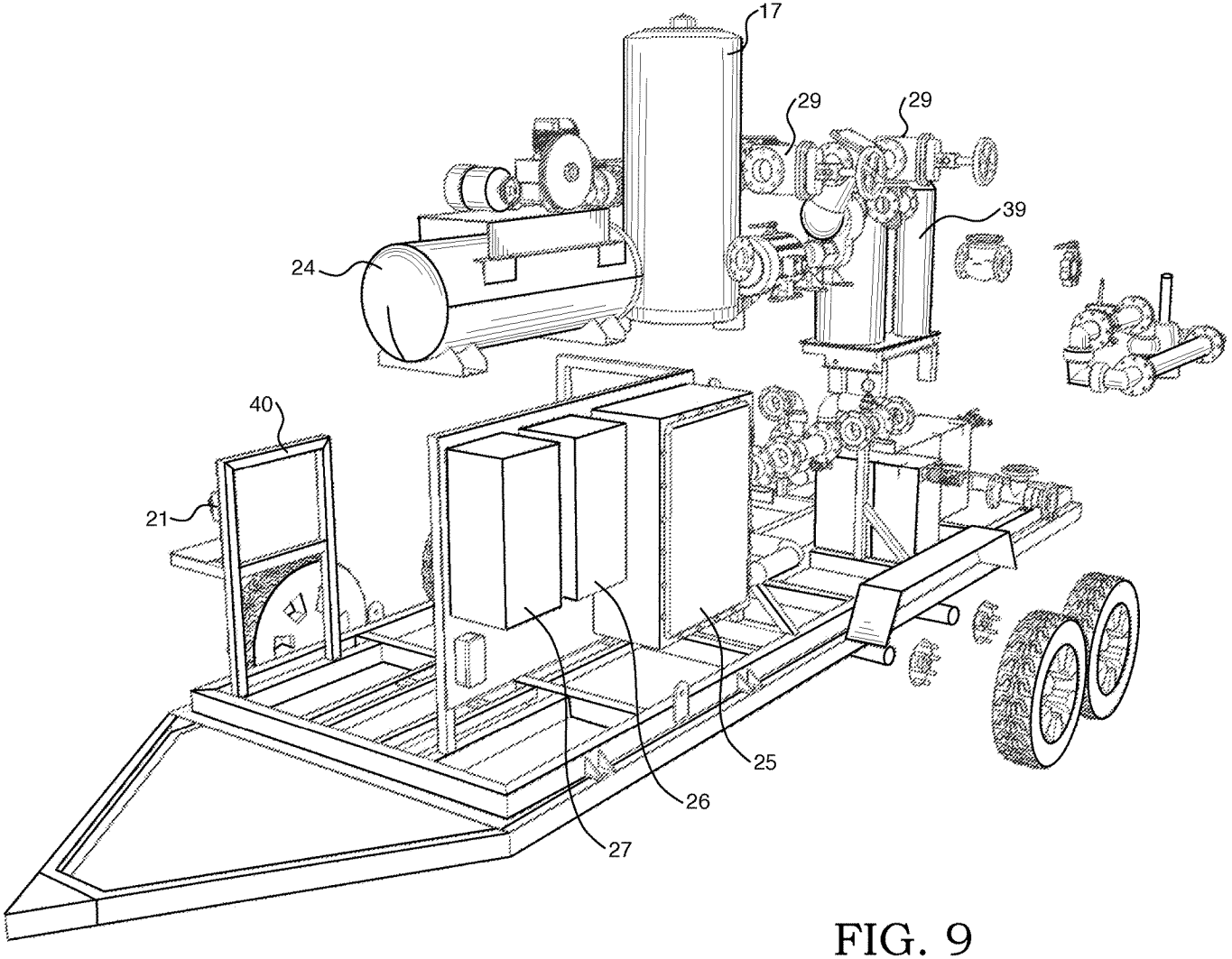

FIGS. 1-2 provide an example of an implementation of a mobile fuel transloading system 10 in use for the transfer of fuel from a rail car to a tanker truck. While implementations of the system may be referred to herein as a mobile fuel transloading system 10, it is intended that the system may be used to transfer liquids other than fuel and that the system may therefore serve as a mobile liquid transferring system that is not limited to use in the fuel transloading industry. Within the fuel industry, however, it is contemplated that the mobile fuel transloading system 10 may be used to transfer gasoline, diesel, ethanol, biodiesel, and the like. As shown, in some embodiments, a first fluid conduit 31 is secured to a first tank of fuel, depicted here by non-limiting example, as a rail car. The mobile transloading system 10 is then used to transfer fuel via a second fluid conduit 32 into a second tank, shown here by non-limiting example as a tanker truck. The mobile transloading system may be in the form of a trailer comprising wheels 30 and may be towed by a vehicle and placed at a position between the two fuel tanks such that all necessary connections between the fuel tanks and the mobile transloading system 10 are easily facilitated.

Figure 10:
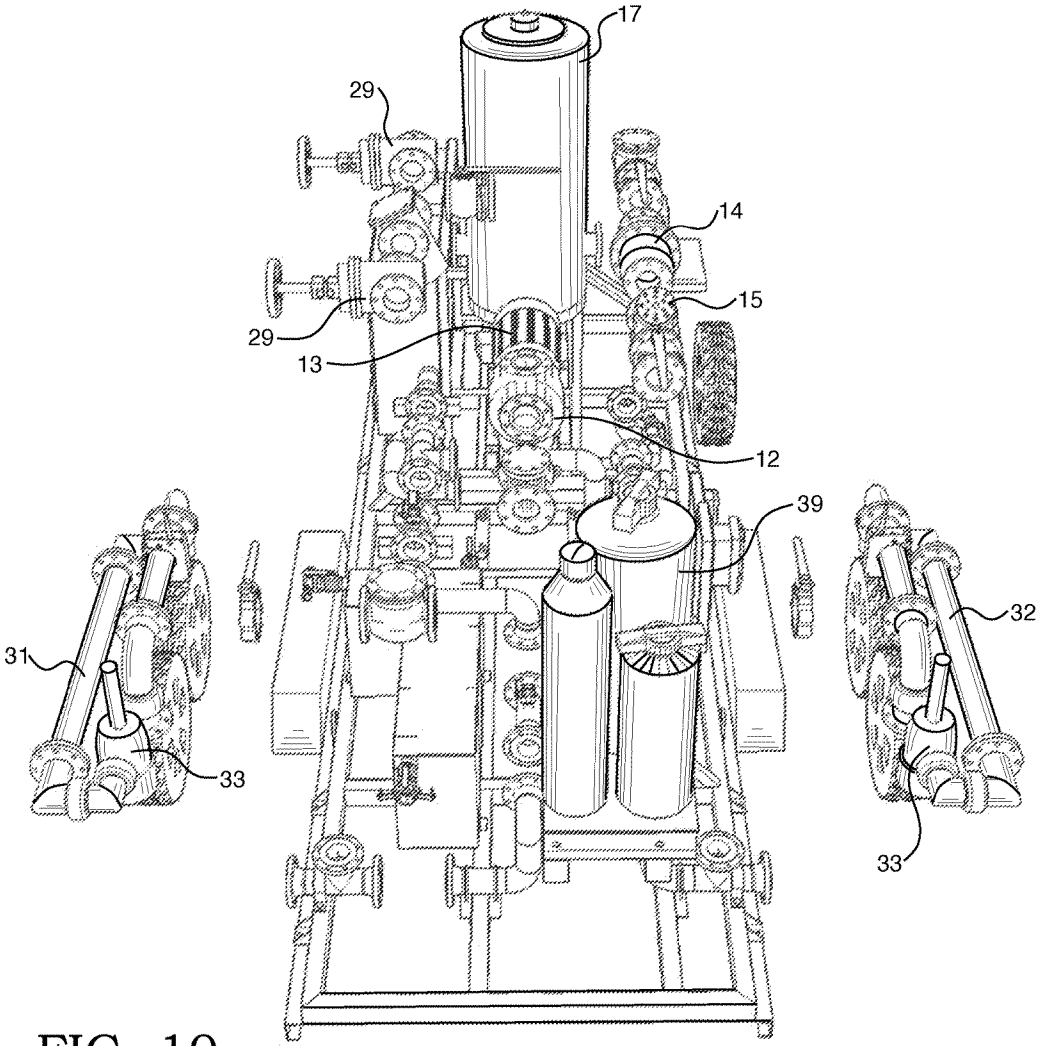
Figure 11:
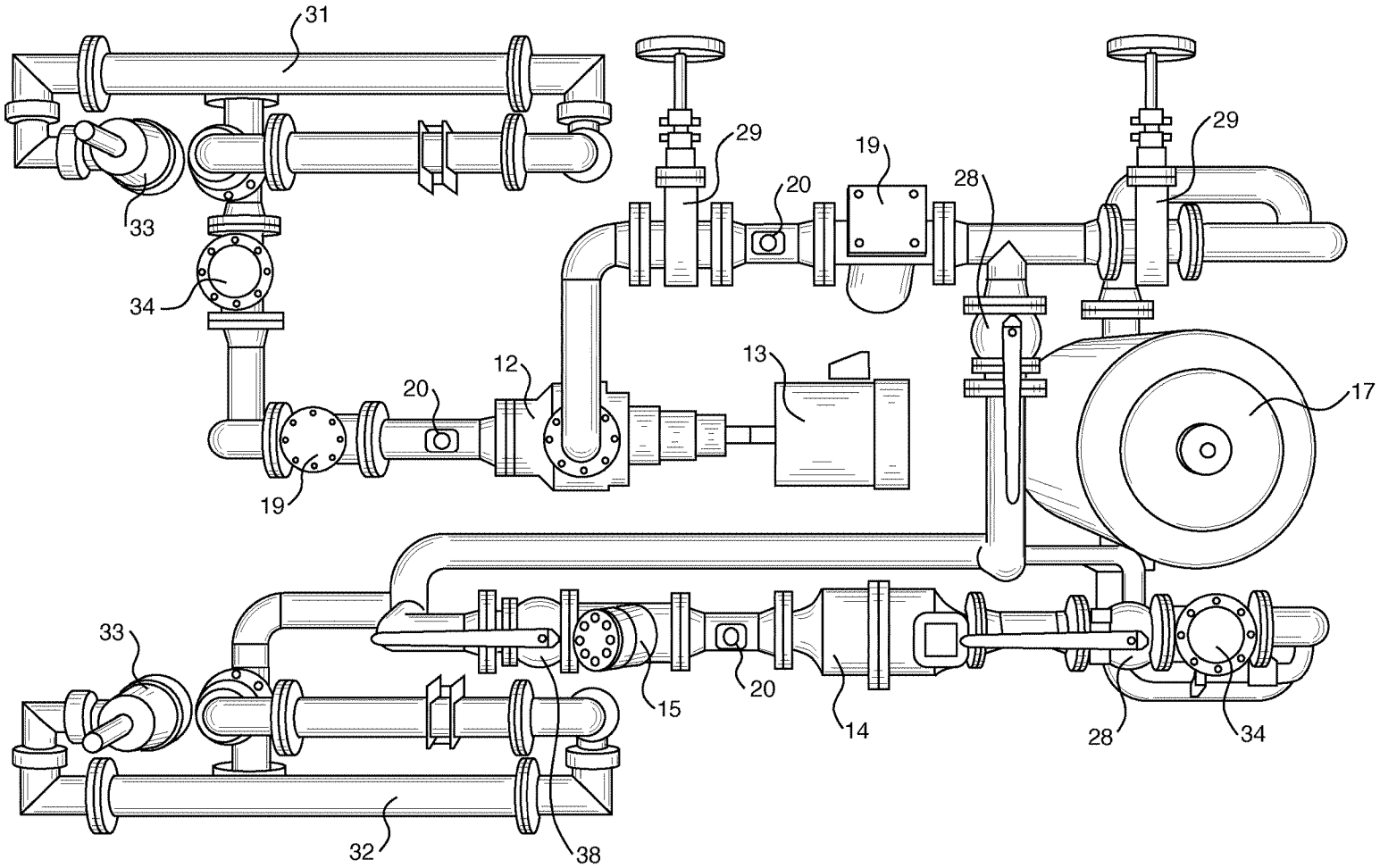
FIGS. 11-13 depict top views of exemplary embodiments of system components of a mobile fuel transloading system.
Figure 12:
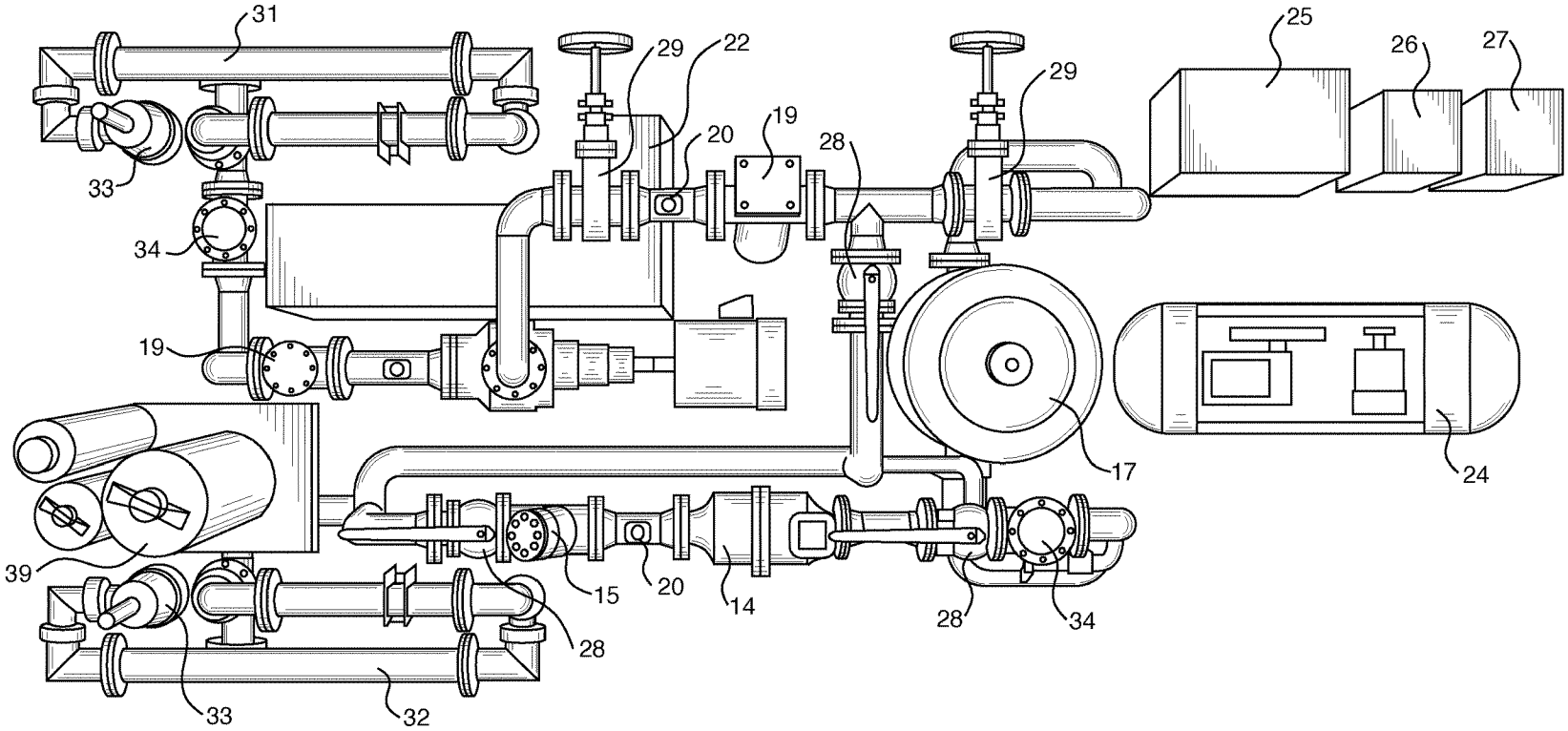
Figure 13:
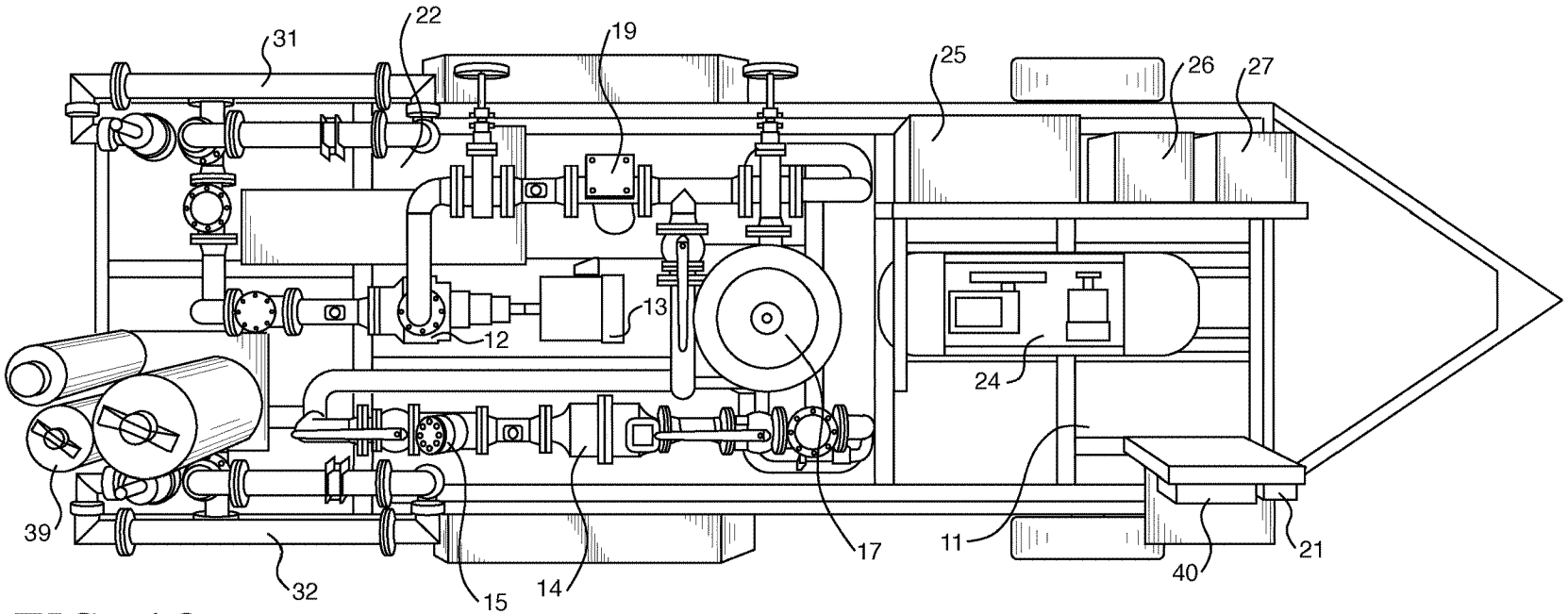
Figure 14:
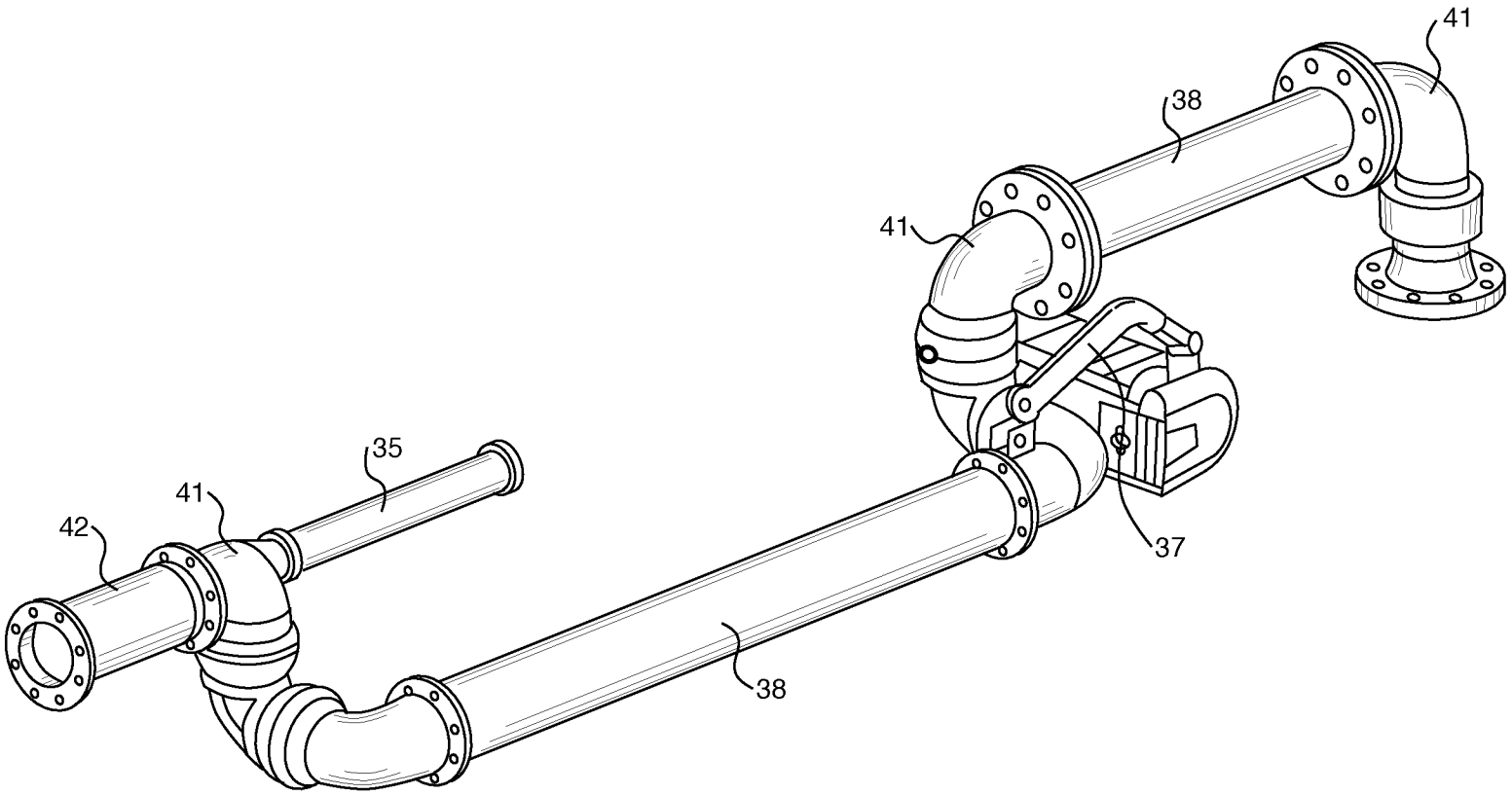
FIGS. 14-19 depict exemplary embodiments of articulating fluid conduits in accordance with implementations of a mobile fuel transloading system.
Figure 15:
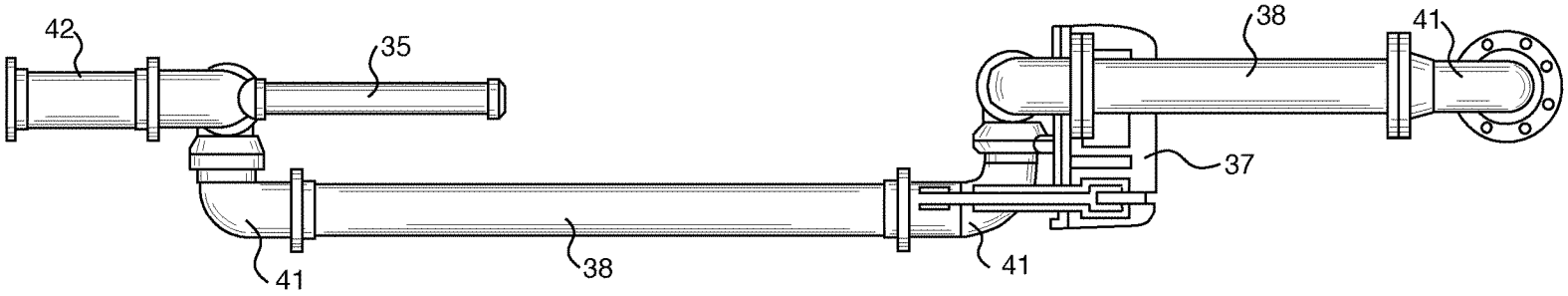
Figure 16:
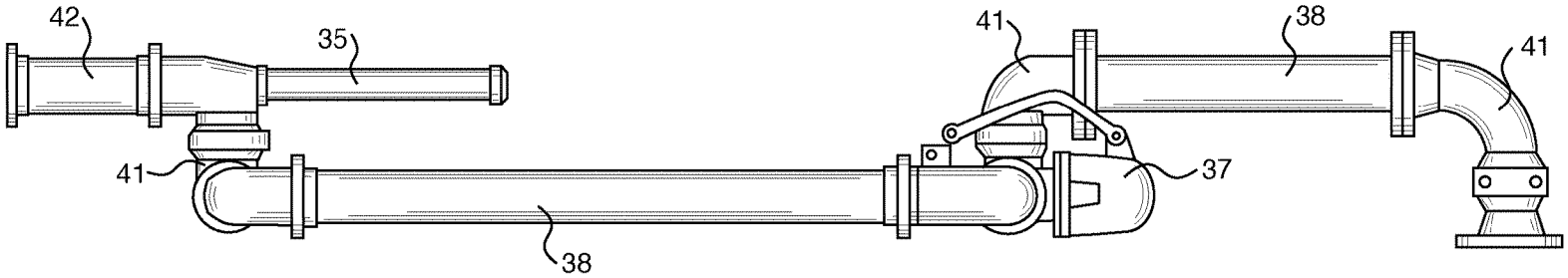
Figure 17:
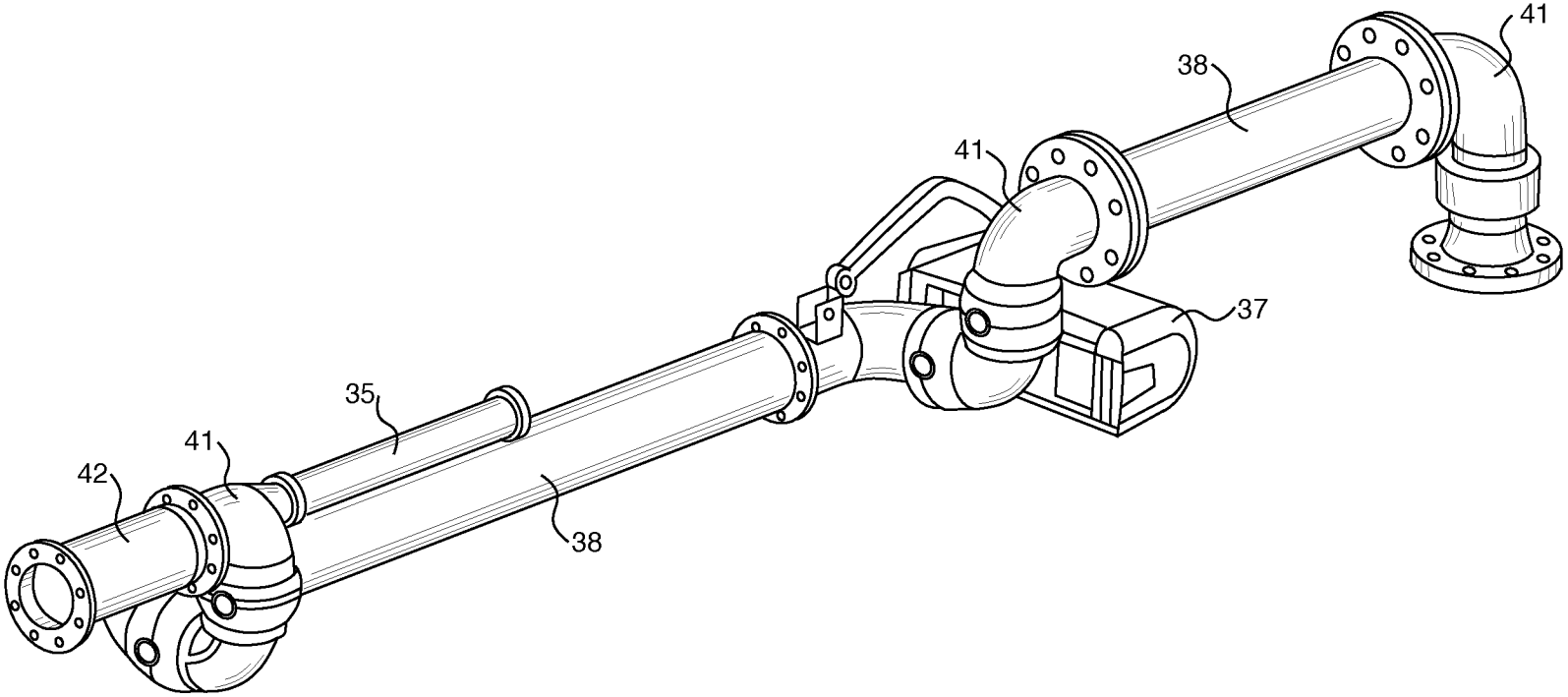
Figure 18:
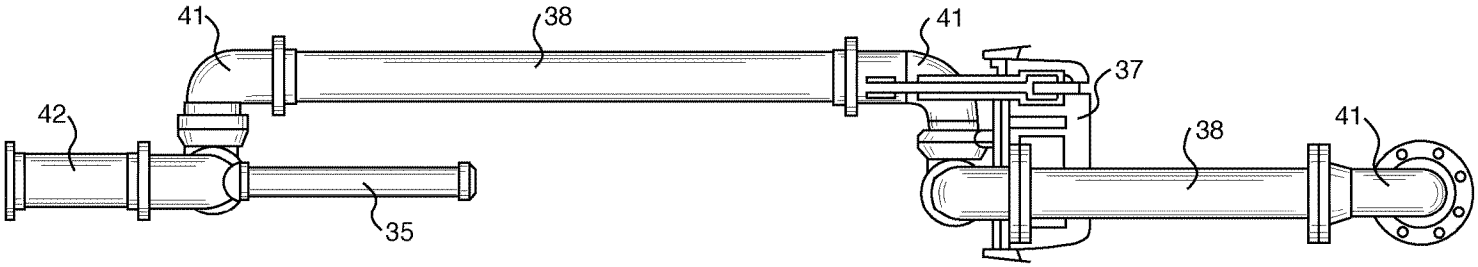
Figure 19:
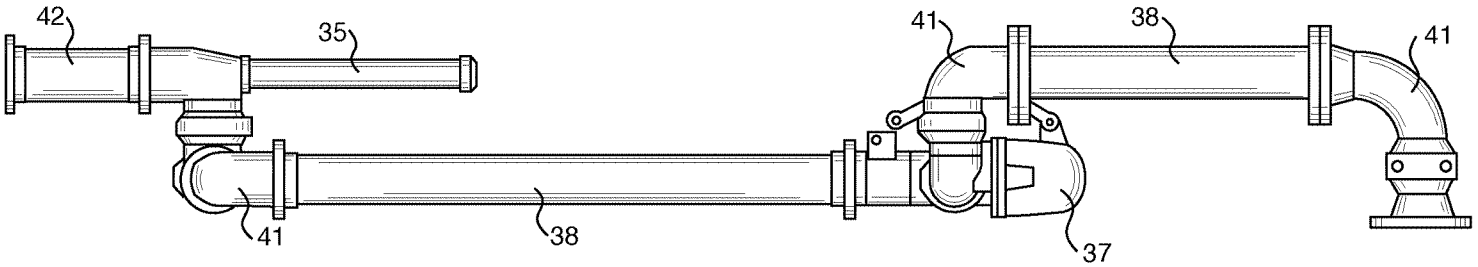

FIGS. 3-10 provide exploded views of one or more implementations of a mobile fuel transloading system 10 depicted from various angles in an effort to more clearly show the components and exemplary configurations of these components. It is to be understood that while particular configurations, coupling points, couplings and the like are shown for illustrative purposes, these are not intended to be limited as such and any other suitable configurations, coupling points, and couplings may be used for any combinations or subcombinations of any or all of the disclosed components. FIGS. 11-13 also provide exemplary elements and configurations and depict at least some of the elements that may comprise a mobile fuel transloading device 10 without the trailer and trailer platform 11 shown in FIGS. 11-12 to enhance clarity.

Turning now to FIGS. 3-10, various system components may be coupled to a platform 11 of a mobile fuel transloading system 10 which may be housed on a trailer. In some implementations, the mobile fuel transloading system 10 may comprise a vapor balance system 22 (shown in FIGS. 4 and 12). Prior to transloading any flammable fuel having a vapor pressure at or above a predetermined level, one or more vapor conduits may be coupled to the vapor balance system 22 and at least one of the first and second tanks between which fuel is being transferred. Implementations may comprise a pump 12 and a motor 13 configured to drive the pump 12. In some embodiments, pump 12 may comprise a self-priming centrifugal pump, however, any appropriate pump 12 may also be used. While the pump 12 may be of any capacity, in some implementations, the pump 12 and motor 13 may have a capacity within a range of 400 to 800 gallons per minute. The pump motor 13 may comprise an explosion proof electric motor and may have a horse power within a range of, by non-limiting example, 15-50 HP. The pump starter 26 (shown in FIG. 4) may be enclosed so as not to pose a fire hazard when in use during fuel transloading.

In order to implement the fuel transloading process using the mobile fuel transloading system 10, an operator couples a first fluid conduit 31 to a first tank, which may be by non-limiting example, a rail car. While any appropriate fluid conduit may be used, in some implementations of the mobile fuel transloading system 10, the first fluid conduit 31 may comprise an articulating first fluid conduit 31, the features of which will be discussed in further detail below with regard to FIGS. 14-19. Prior to undertaking any transloading of a flammable substance, the mobile fuel transloading system 10 must be electrically grounded. Some implementations of the mobile fuel transloading system 10 disclosed herein may comprise an overfill prevention system 18 that also comprises monitoring to ensure that the grounding connection is intact throughout the loading operation using either a ground ball and grounding plug connector or a separate cable and clamp connection. The overfill prevention system 18 may establish a mobile transloading system 10 to tank bond to drain static charges from the vehicle and may communicate with an overfill protection system and/or probes on tanker trucks or other vehicles being filled to prevent overfilling of the tanks or tank compartments. The overfill prevention system 18 may signal for automatic shut-off of product flow when an overfill or fault is detected.

A second fluid conduit 32 is coupled to a second tank prior to the transloading process taking place. While any appropriate fluid conduit may be used, in some implementations, the second fluid conduit 32 may comprise an articulating fluid conduit, the features of which will be discussed in detail below with regard to FIGS. 14-19. Once the first and second fluid conduits 31, 32 are coupled to the first and second tanks, respectively, one or more vapor conduits are coupled to the first and/or second tanks, electric ground has been established, and the pump 12 and motor 13 are running, the transloading process may occur. In order to load a correct volume of product into the second tank, an operator enters one or more loading parameters and an initial preset volume for the desired compartment of the second tank that is to be loaded into a computerized meter register 40 that serves as a batch controller. It should be noted that the terms "meter register" and "batch controller" will be used interchangeably throughout this disclosure. If multiple compartments of the second tank are to be filled, one or more loading parameters and an initial preset volume may be entered for these additional compartments as well. The one or more loading parameters may comprise, by non-limiting example, a product type, batch size, supplier, customer, carrier, vehicle identification, driver identification, and the like. The computerized meter register 40 may comprise an electronic interface and may be configured to control various loading functions such as, by non-limiting example, product flow, product measurement, and emergency shutdown.

The operator may open one or more valves, depicted here by non-limiting example as ball valves 28 and/or gate valves 29 to allow the fuel or other liquid to flow into the first fluid conduit 31, through the mobile transloading system 10 and to pass through the second fluid conduit 32 and into the second tank. The system may comprise one or more check valves 34 to ensure that the fuel travels only downstream during the loading process.

In some implementations, the mobile fuel transloading system 10 may comprise a flow meter 14 comprising a plurality of pick-offs each comprising a meter pulse transmitter and configured to produce an electric signal in response to sensing mechanical motion of a liquid flowing through the flow meter. While it is contemplated that the flow meter 14 may comprise any number of pick-offs, in some embodiments, the flow meter 14 may comprise a first pickoff and a second pickoff that are configured at a 90 degree electrical offset. This 90 degree electrical offset would typically 1) indicate a forward or backward flow of a single product through the flow meter 14 and 2) provide a second, redundant meter pulse transmitter in case of a failure. In the disclosed implementations, however, this 90 degree electrical offset a combination of relays and discreet electrical circuits between each of the two meter pick-offs and the meter register 40 may be configured such that the meter register 40 recognizes the first and second pick-offs as two separate flow meters 14 rather than one. Without this configuration, the meter register 40, which can be configured to monitor multiple flow meters 14 for blending operations or to load multiple product streams separately, would receive meter pulses from both pick-offs simultaneously which would cause the meter register to operate as if two products were being blended to create a mixture of the two products when filling the second tank. In the disclosed implementations, however, when an operator selects a product to be transloaded by the meter register 40, the meter register 40 activates the relay that is between the pickoff for that product and the meter register 40. The relay for the unused pickoff is deactivated and thus, by having only one meter pulse transmitter sending pulses to the meter register 40 at a time, the meter register 40 recognizes both pick-offs as being two separate flow meters 14. This allows for metering of two different products having different viscosities or specific gravities (for example, ethanol and biodiesel) without needing to reconfigure the meter register 40 once the meter register 40 has been configured with one or more liquid parameters for each product that will pass through the flow meter 14. By non-limiting example, the one or more liquid parameters may comprise a viscosity, a specific gravity, a type of liquid, a liquid temperature, a liquid pressure, and the like.

In some implementations, a flow control valve 15 may be located downstream and in fluid communication with the flow meter 14. While it is contemplated that any type of flow control valve 15 may be used, in some embodiments, the flow control valve 15 may be a set stop valve and may comprise a digital solenoid operated control valve configured to provide flow rate control and batch delivery of fluids when used with meter register 40. Such a flow control valve 15 may be controlled by an electronic preset for low flow start up, high flow rate control, low flow shutdown, and final shut-off. In some implementations, the flow control valve 15 may comprise an external pilot control loop comprising a normally-open solenoid pilot, a normally-closed solenoid pilot, a strainer, and opening/closing speed controls.

Some implementations of a mobile fuel transloader 10 may comprise a remote terminal unit 21 that is configured to provide Internet switching and act as a communication access point between the meter register 40 and a remote terminal management system such that real-time transactional data regarding product loading may be transmitted to the remote terminal management system. In some embodiments, the remote terminal unit 21 may be a cellular or satellite remote terminal unit. The batch controller (meter register) 40 may be configured to interface with a unified automation platform (UAP) that provides loading operations management, processing of gains and losses and appropriate reports, and remote tank level monitoring. In some implementations, the mobile fuel transloader 10 is recognized as a loading facility location in the UAP.

Some implementations of the mobile fuel transloading system 10 may comprise an air eliminator 17 that is in fluid communication with the aforementioned components and fluid conduits of the mobile fuel transloading system 10. The air eliminator 17 may be located upstream the flow meter 14 to remove any air from the product line prior to reaching the flow meter 14 which improves the accuracy of the flow meter 14 because positive displacement and turbine meters are not able to differentiate between liquid, air, and vapor due to the fact that they are volumetric measuring devices. By decreasing a velocity of product flow, air bubbles or vapor will rise from the product and collect in a top portion of the air eliminator to be discharged. This may be particularly beneficial when the first tank to which the first fluid conduit 31 is coupled has been at least partially emptied thereby increasing the chances of introducing air into the first fluid conduit 31.

Some embodiments of the mobile fuel transloading system 10 may comprise an air compressor 24 coupled to the trailer platform 11 which may be used to blow air into one or more product lines when the mobile fuel transloading system 10 is not in use so as to remove any material or other buildup that may be present in the system. One or more in-line strainers 19 may be used throughout the system to filter debris and unwanted materials from the product as it flows through the mobile transloading system 10. For example, as shown in FIGS. 11-13, an in-line strainer may be positioned downstream a first gate valve 29 and upstream a second gate valve 29. As another non-limiting example, an in-line strainer may be positioned proximal to and downstream the first fluid conduit 31 to filter material from the incoming product. One or more pressure gauges 20 may be utilized throughout the system to determine pressure at various points in the system. By non-limiting example, as shown in FIGS. 11-13, a pressure gauge 20 may be positioned downstream the first gate valve 29. While shown upstream an in-line strainer 19, the pressure gauge 20 may be located downstream the in-line strainer 19 as well in embodiments that comprise such an in-line strainer 19. In some embodiments, a pressure gauge 20 may be located upstream the pump 12 and/or between the flow meter 14 and the flow control valve 15.

Some implementations may further comprise a fire suppression system 39 that may comprise a plurality of tanks comprising one or more fire suppression substances, each of which may be selected to extinguish fire resulting from a different type of fuel such as biodiesel, ethanol and petroleum products such as gasoline and diesel fuel, by non-limiting example. One or more tanks may comprise an Aqueous Film-Forming Foam ("AFFF"), such as, by non-limiting example, Arctic 3×3 (premix), for use with Class B flammable and combustible liquids and/or a dry chemical agent such as, by non-limiting example, Amerex Purple K, that may be used to combat fires in flammable liquids, including polar solvent fuels such as ethanol, gases, and greases (Class B) including such fires involving energized electrical equipment (Class C). Depending upon the regulatory requirements of the municipality in which the mobile fuel transloading system 10 is being used, the presence of such a multi-tank fire suppression system 39 on the mobile fuel transloading system 10 may provide a significant cost savings by eliminating the need for a permanent fire suppression system at the transloading location. Additionally, to safely house wiring and electronic components in an environment where hazardous vapors may be present, NEMA 7 Class 1, Division 1, Group D enclosures and/or junction boxes may be utilized for example, to house the pump starter 26, air compressor starter, 27, and distribution enclosure 25 which houses power distribution blocks, a power transformer, a phase protection relay, fuse blocks, selector switches, push buttons, a cellular internet access device with Wi-Fi capability, contactors for lighting and power control, and various other control relays.

Turning now to FIGS. 14-19, various implementations of first and/or second fluid conduits 31, 32 are depicted. In some embodiments the first and/or second fluid conduits 31, 32 may be articulating fluid conduits as shown. It is to be understood that the first and/or second fluid conduits 31, 32 may comprise any articulating configuration that allows the first and/or second fluid conduit 31, 32 to be retracted and stored along a side of the mobile transloading system 10, however by non-limiting example, the particular configurations of FIGS. 14-19 may allow for the first and/or second fluid conduits 31, 32 to be neatly and unobtrusively stored when not in use and may prevent spillage which is common when using conventional hoses and/or pipes. In some implementations, the first and/or second fluid conduit 31, 32 may comprise one or more lengths of pipe 38 coupled by a swivel joint 41. An additional swivel joint 41 may be coupled to an end of a pipe length 38 which is coupled to a handle 35 extending outward from the swivel joint 41 and which is also coupled to a pipe spool spacer 42. The pipe spool spacer may be configured to couple to a dry brake coupler 33 as shown in FIGS. 10-12 for securing to a first or second tank. A swivel joint 41 may also be located at an end of the first and/or second fluid conduit 31, 32 distal the handle 35 and may be configured to couple to a product line of the mobile transloading system 10. In some embodiments, a spring balance unit 37 may be positioned at a swivel joint 41 that couples two pipe segments 38 together to provide support and balancing of the fluid conduit when an operator swings the first and/or second fluid conduit 31, 32 into place to secure to a first or second tank when the first and/or second fluid conduit 31, 32 is extended outward from the mobile transloading system 10. Similarly, the spring balance unit 37 provides support and balancing of the fluid conduit when an operator disconnects the first and/or second fluid conduit 31, 32 from the first or second tank and swings the first and/or second fluid conduit 31, 32 back toward the mobile transloading system 10 where it may be stored in a retracted position.

In places where the description above refers to particular implementations of a mobile fuel transloading system, it should be readily apparent that a number of modifications may be made without departing from the spirit thereof and that these implementations may be applied to other to systems and techniques for mobile fuel transloading systems.

What is claimed is:

1. A mobile liquid transferring system comprising:

a first articulating fluid conduit configured to couple to a first tank;

a pump positioned on a platform, the pump comprising a pump inlet and a pump outlet, the pump inlet in fluid communication with the first articulating fluid conduit;

a flow meter in fluid communication with the pump, the flow meter comprising a first pickoff for a first liquid of a first viscosity and a second pickoff for a second liquid of a second viscosity;

a meter register configured to control flow of the first liquid and the second liquid in accordance with one or more loading parameters and one or more liquid parameters;

a flow control valve in fluid communication with the flow meter and configured to alter flow of at least one of the first liquid and the second liquid in response to a communication from the meter register; and a second articulating fluid conduit in fluid communication with the flow control valve and configured to couple to a second tank.

2. The mobile liquid transferring system of claim 1, wherein at least one of the first articulating fluid conduit and the second articulating fluid conduit comprise a spring proximal a joint, the spring configured to counterbalance a weight of at least a portion of the at least one of the first articulating fluid conduit and the second articulating fluid conduit.

3. The mobile liquid transferring system of claim 1, wherein at least one of the first articulating fluid conduit and the second articulating fluid conduit are configured to retract and be positioned proximal the platform when uncoupled from at least one of the first tank and the second tank.

4. The mobile liquid transferring system of claim 1, wherein at least one of the first articulating fluid conduit and the second articulating fluid conduit further comprise a dry brake coupler.

5. The mobile liquid transferring system of claim 1, further comprising an air eliminator configured to remove air from at least one of the first liquid and the second liquid when either the first liquid or the second liquid is flowing through the mobile liquid transferring system.

6. The mobile liquid transferring system of claim 1, further comprising a remote terminal unit configured to communicate with a remotely located terminal management system.

7. The mobile liquid transferring system of claim 1, further comprising a vapor balance system configured to balance vapor emitted by at least one of the first liquid and the second liquid.

8. The mobile liquid transferring system of claim 1, further comprising an in-line strainer.

9. The mobile liquid transferring system of claim 1, further comprising an overfill prevention control unit.

10. The mobile liquid transferring system of claim 1, further comprising a fire suppression system.

11. A mobile liquid transferring system comprising:

a first articulating fluid conduit configured to couple to a first tank;

a pump positioned on a platform, the pump comprising a pump inlet and a pump outlet, the pump inlet in fluid communication with the first articulating fluid conduit;

a flow meter in fluid communication with the pump;

a meter register configured to control flow of a liquid in accordance with one or more loading parameters and one or more liquid parameters;

a flow control valve in fluid communication with the flow meter and configured to alter flow of the liquid in response to a communication from the meter register; and a second articulating fluid conduit in fluid communication with the flow control valve and configured to couple to a second tank, wherein at least one of the first articulating fluid conduit and the second articulating fluid conduit comprise a spring proximal a joint and a dry brake coupler configured to couple the at least one of the first articulating fluid conduit and the second articulating fluid conduit to at least one of the first tank and the second tank.

12. The mobile liquid transferring system of claim 11, wherein the flow meter comprises a first pickoff for a first liquid of a first viscosity and a second pickoff for a second liquid of a second viscosity and the meter register is configured to control flow of the first liquid and the second liquid in accordance with the one or more loading parameters and the one or more liquid parameters.

13. The mobile liquid transferring system of claim 11, wherein at least one of the first articulating fluid conduit and the second articulating fluid conduit are configured to retract and be positioned proximal the platform when uncoupled from at least one of the first tank and the second tank.

14. The mobile liquid transferring system of claim 11, further comprising an air eliminator configured to remove air from the liquid when the liquid is flowing through the mobile liquid transferring system.

15. The mobile liquid transferring system of claim 11, further comprising an overfill prevention control unit configured to stop flow of the liquid upon detection that the second tank is overfilled and verify that the mobile liquid transferring system is at an electrical ground.

16. A mobile liquid transferring system comprising:

a first fluid conduit configured to couple to a first tank;

a pump positioned on a platform, the pump comprising a pump inlet and a pump outlet, the pump inlet in fluid communication with the first fluid conduit;

a flow meter in fluid communication with the pump, the flow meter comprising a first pickoff for a first liquid of a first viscosity and a second pickoff for a second liquid of a second viscosity;

a meter register configured to control flow of the first liquid and the second liquid in accordance with one or more loading parameters and one or more liquid parameters;

a flow control valve in fluid communication with the flow meter and configured to alter flow of at least one of the first liquid and the second liquid in response to a communication from the meter register; and a second fluid conduit in fluid communication with the flow control valve and configured to couple to a second tank.

17. The mobile liquid transferring system of claim 16, further comprising a remote terminal unit configured to communicate with a remotely located terminal management system.

18. The mobile liquid transferring system of claim 16, further comprising a vapor balance system configured to balance vapor emitted by at least one of the first liquid and the second liquid.

19. The mobile liquid transferring system of claim 16, wherein at least one of the first fluid conduit and the second fluid conduit are configured to retract and be positioned proximal the platform when uncoupled from at least one of the first tank and the second tank.

20. The mobile liquid transferring system of claim 16, further comprising an overfill prevention control unit configured to stop flow of the liquid upon detection that the second tank is overfilled and verify that the mobile liquid transferring system is at an electrical ground.

* * * * *